US007085518B2

(12) United States Patent
Yamaguchi et al.

(10) Patent No.: US 7,085,518 B2
(45) Date of Patent: Aug. 1, 2006

(54) ADHESIVE MATERIAL FOR PROCESSING DEVICE, PROCESS CARTRIDGE, AND ELECTROPHOTOGRAPHIC IMAGE FORMING APPARATUS

(75) Inventors: Yuuko Yamaguchi, Hachioji (JP); Shigeki Takenouchi, Hachioji (JP); Ken Ohmura, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 183 days.

(21) Appl. No.: 10/806,817

(22) Filed: Mar. 23, 2004

(65) Prior Publication Data

US 2005/0214024 A1 Sep. 29, 2005

(51) Int. Cl.
*G03G 15/00* (2006.01)

(52) U.S. Cl. ..... 399/111; 399/113

(58) Field of Classification Search ..... 399/111, 399/113, 167, 179, 280–286; 430/350, 66
See application file for complete search history.

(56) References Cited

U.S. PATENT DOCUMENTS

| | | | | |
|---|---|---|---|---|
| 6,272,300 | B1 * | 8/2001 | Fujiwara et al. | 399/113 |
| 6,725,005 | B1 * | 4/2004 | Ueda et al. | 399/167 |
| 2004/0038156 | A1 * | 2/2004 | Oyamada et al. | 430/350 |
| 2004/0058281 | A1 * | 3/2004 | Yamane et al. | 430/350 |

FOREIGN PATENT DOCUMENTS

| | | |
|---|---|---|
| JP | 06-130740 | 5/1994 |
| JP | 2003129027 | * 10/2001 |

* cited by examiner

*Primary Examiner*—Brij B. Shrivastav
(74) *Attorney, Agent, or Firm*—Lucas & Mercanti

(57) ABSTRACT

An image forming apparatus comprising: a photoreceptor; and a plurality of processing devices to form an image, wherein at least one of the processing devices include a portion assembled by an adhesive material including a volatile gas component in an amount of 0.1–9 μg/cm$^2$.

16 Claims, 2 Drawing Sheets

ADHESIVE MATERIAL FOR PROCESSING DEVICE, PROCESS CARTRIDGE, AND ELECTROPHOTOGRAPHIC IMAGE FORMING APPARATUS

BACKGROUND

1. Technical Field

The present invention relates to an adhesive material for use in a processing device necessary to form an electrophotographic image, and to a process cartridge and an electrophotographic image forming apparatus, in which the adhesive material is used.

2. Related Art

An image forming apparatus such as a printer utilizing an electrophotographic system has an electrophotographic photoreceptor and processing devices arranged around the photoreceptor such as a charging device, an image exposing device, a developing device, a transfer device, and a cleaning device. An electrophotographic image is formed by the functions, e.g., charging, developing or the like, of the processing devices, such as the charging device and the developing device, on the photoreceptor. Each processing device is composed of a plurality of members or components coupled to each other with a coupling member. As such a coupling member, a mechanical coupling member having projections and depressions at coupling portions, an adhesive material, for example, a double-faced adhesive tape, or the like may be used. The coupling members are often used in combination to assemble a processing device for reasons of cost and convenience. In order to couple mechanically all the members or components of a processing device, each member or component is required to have a structure suitable for mechanical coupling. In reality, however, there are some coupling portions which are not suitable for mechanical coupling or which significantly increase the production costs thereof when mechanically coupled. In such cases, chemical means are generally used for coupling.

In recent years, an adhesive material such as a double-faced adhesive tape has been widely used as the chemical coupling member. However, when a processing device fabricated by utilizing a commercially available adhesive material is incorporated in an electrophotographic image forming apparatus and images are formed, image unevenness often occurs. The present inventors examined the causes of the image unevenness and found that commercially available adhesive materials contain some volatile substance which vaporizes in the image forming apparatus to have an effect on the photoreceptor and to deteriorate the performance thereof.

SUMMARY

The first aspect is an adhesive material including a volatile gas component in an amount of 0.1–9 μg/cm$^2$. The second aspect is a process cartridge to be loaded in an image forming apparatus, comprising a photoreceptor and at least one processing devices, wherein at least one of the processing devices include a portion assembled by an adhesive material. The third aspect is an image forming apparatus comprising a photoreceptor and a plurality of processing devices to form an image, wherein at least one of the processing devices include a portion assembled by an adhesive material. By these aspects, the advantage of reduction or no occurrence of fluctuation of image quality may be obtained.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

DETAILED DESCRIPTION

Figure 1:
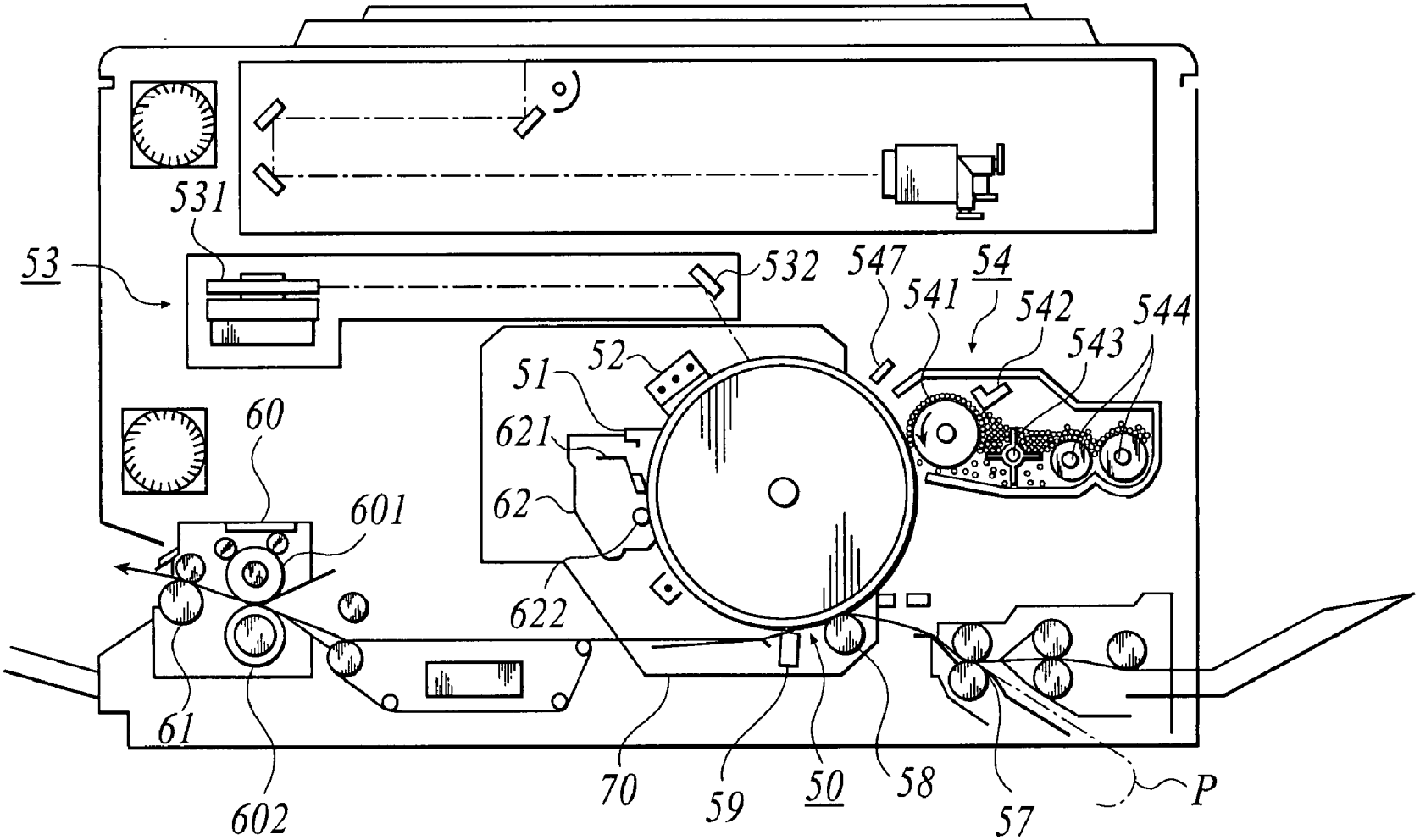
FIG. 1 is a sectional view of an electrophotographic image forming apparatus according to an embodiment of the invention.

An embodiment of an adhesive material for a processing device, a process cartridge and an electrophotographic image forming apparatus will be hereinafter described in detail, with reference to the accompanying drawings. The description are not intended to limit the scope of the claims nor to limit the definition of terms in the claims.

As a coupling member for assembling at least one of a plurality of processing devices arranged around an electrophotographic photoreceptor, an adhesive material for a processing device is used as follows. That is, as an adhesive material for the processing device, an adhesive material including a volatile gas component in an amount of 0.1–9 μg/cm$^2$, an adhesive material including monomer residue in an amount of 0.1–7.5 μg/cm$^2$, or an adhesive material including solvent residue in an amount of 0.001–0.007 μg/cm$^2$, is used.

The adhesive material for the processing device may be one which satisfies at least one of the above conditions and of course it may be one which satisfies all of the conditions.

The plurality of processing devices include devices and equipments which act on the electrophotographic photoreceptor (which may be hereinafter referred to simply as "photoreceptor") to form an electrophotographic image such as a charging device, an image exposing device, a developing device, a transfer device, a cleaning device, a feeding device and a separating device.

The adhesive material for the processing device may be used for all of the processing devices, for any one thereof, or also for two or more processing devices.

In the electrophotographic image forming apparatus of the embodiment, all the units are not necessarily arranged around the photoreceptor. For example, the cleaning device may be combined with the developing device. Also, the electrophotographic image forming apparatus may have no transfer device.

The adhesive material for use in assembling a processing device is an adhesive tape or the like, which couples or bonds the members or components of the processing device.

An adhesive material for a photoreceptor according to the embodiment has a volatile gas component in an amount of 0.1–9 μg/cm$^2$. The volatile gas comprises: volatile components such as monomer components or the like which are contained in raw materials for producing the adhesive material; and volatile components such as solvents, additives and the like, which are used in the process of producing the adhesive material. In the embodiment, the volatile gas amount is defined as the amount of gas measured by the method described below. However, any other measuring instrument may also be used for measurement as long as it is based on the same measuring principle and it can provide the same results.

Method for Measuring the Amount of Volatile Gas

The volatile gas amount is measured with a dynamic head space method using a measuring instrument GC-MS (HP6890 manufactured by Hewlet-Packard Company; and JMS-AMII150 manufactured by JEOL Ltd.). A sample with a size of 1 $cm^2$ is heated at 120° C. for 10 minutes and the amount of volatile gas generated is measured. The amount of the volatile gas is calculated in terms of n-pentadecane.

That is, 1 $cm^2$ of the sample is applied into a sampling tube having cell volume of 20 cmϕ×4 cm (1256 ml), and heated at 120° C. for 10 min. Volatile gas is collected into a collection tube filled up with 100 mg of Tenax TA, where purge gas is pure helium gas and the sample is prepurged for 30 min and purged for 30 min. The collected constituents are introduced to the above GC-MS and measured. Quantitative Determination of the volatile gas is performed by calculating with a calibration curve in which n-pentadecan is a standard sample.

Condition of GC-MS Analysis

Column: CP-SIL5CB-MS 0.25 mm×60 m df=0.25μm

Column temperature: kept at 40° C. for 5 min, followed by raised up to 280° C. at a rate of 2° C. per minute.

Carrier gas: He, 1 ml/min

An adhesive material for the photoreceptor according to the embodiment has a residual monomer in an amount of 0.1–7.5 μg/$cm^2$. The residual monomer means that the monomer of a raw material for the adhesive material remains therein. The amount of residual monomer is measured by the following method.

Method for Measuring the Amount of Residual Monomer:

The amount of residual monomer is measured by the same method as the measurement of the amount of volatile gas.

Namely, a sample with a size of 1 $cm^2$ is heated at 120° C. for 10 minutes and the amount of volatile gas generated is measured. The amount of the residual monomer is calculated in terms of n-pentadecane.

An adhesive material for a processing device according to the embodiment has a residual solvent amount of 0.001–0.007 μg/$cm^2$. This means that the solvent used in the process of producing the adhesive material remains therein. The amount thereof will be measured by the following method.

Method for Measuring the Amount of Residual Solvent

The amount of residual solvent is measured with the same method as in measuring the amount of volatile gas.

Namely, a sample with a size of 1 $cm^2$ is heated at 120° C. for 10 minutes and the amount of volatile gas generated is measured. The amount of the residual solvent is calculated in terms of n-pentadecane.

The adhesive material for a processing device according to the embodiment has an adhesive layer (adhesive agent) in the form of a sheet (or a tape) of an adhesive compound such as polyvinyl methyl ether, polyvinylethylene ether, polyvinyl isobutyl ether, polyisobutylene, butyl rubber, chloroprene rubber, SBR, chlorinated rubber, cyclized rubber, vinyl chloride-vinyl acetate copolymer, polymethacrylic acid, polyacrylic acid, polymethacrylic ester, polyacrylic ester, ethylene-vinyl acetate copolymer, polyvinyl butyral, or a mixture of two or more thereof. The adhesive material according to the embodiment may have a support besides the adhesive layer. The adhesive layer may contain a tackifier such as rosin, a rosin derivative, a petroleum resin or the like.

The residual monomer is the monomer used to prepare the above rubber, polymer, resin or the like, and the residual solvent is the solvent used to dissolve the monomer, that is, an alcohol solvent, a ketone solvent, an aromatic solvent, a halogen solvent or the like. It is considered that the residual solvent and the residual monomer make up a substantial portion of the volatile gas component.

Description will be made of an example of an electrophotographic image forming apparatus for use in the embodiment, examples of the processing device for use in the electrophotographic image forming apparatus, and examples in which the adhesive material according to the embodiment is used as coupling means for the processing devices.

FIG. 1 is a sectional view of the electrophotographic image forming apparatus for use in the embodiment.

In FIG. 1, reference numeral 50 denotes a photoreceptor drum (photoreceptor) as an image carrier comprising a drum, an organic photosensitive layer formed on the drum and a resin layer according to the embodiment formed over the-organic photosensitive layer. The photoreceptor drum 50 is grounded and driven to rotate in a clockwise direction. Designated as 52 is a scorotron charging device which can uniformly charge the peripheral surface of the photoreceptor drum 50 by corona discharge. Prior to the charging by the charging device 52, a pre-exposing device 51 using a light emitting diode or the like may expose the photoreceptor to light to eliminate the charge remaining on the peripheral surface of the photoreceptor so that the trace of the previous image formation on the photoreceptor can be removed.

After the photoreceptor has been uniformly charged, an image exposing device 53 performs image exposure based on an image signal. The image exposing device 53 has a laser diode (not shown) as an exposure light source. A light beam the path of which was bent by a reflective mirror 532 through a rotary polygonal mirror 531, an fθ lens and the like, scans the photoreceptor drum 50 to form an electrostatic latent image thereon.

The potential in an exposed part of the photoreceptor in the embodiment is the potential measured in the vicinity of a portion above the developing position after the surface of the photoreceptor has been uniformly charged by the image exposing device 53 (in a laser exposure system, exposure is performed continuously). The measurement is performed by a potential sensor 547 disposed above the developing position as shown in FIG. 1.

The electrostatic latent image is developed by a developing device 54 which contains a developer comprising a toner and a carrier and disposed in the vicinity of the photoreceptor drum 50. The development is carried out by a developing sleeve 541 which has a magnet therein and rotates to carry the developer. The developing device 54 has developer agitating members 544, a developer feeding member 543, a developer carrying amount regulating member 542 and the like. The developer is agitated and supplied onto the developing sleeve 541. The amount of the developer is regulated by the developer carrying amount regulating member 542. The amount of the developer is generally in the range of 20–200 mg/$cm^2$, although it depends on the linear velocity of the organic electrophotographic photoreceptor used and the specific gravity of the developer.

The developer comprises a carrier and a toner. The carrier comprises ferrite core particles coated with an insulating resin. The toner comprises color particles comprising a styrene-acrylic resin as a principal material, a coloring agent such as carbon black, a charge controlling agent and a low-molecular weight polyolefin of the embodiment, and an external additive such as silica, titanium oxide or the like. The thickness of the developer layer on the developing sleeve 541 is regulated to a thickness of 100–600 μm by the developer carrying amount regulating member. The developer is then fed to the developing area for development. At this time, a DC bias voltage, or, when needed, an AC bias voltage is applied between the photoreceptor drum 50 and the developing sleeve 541. Development is carried out with the developer in contact or non-contact with the photoreceptor.

A recording paper P is supplied to a transferring area by rotation of a paper feeding roller 57 in accordance with the timing of transfer.

In the transferring area, a transferring roller (transferring unit) 58 is pressed against the peripheral surface of the photoreceptor drum 50 in synchronization with the timing of transfer so that the supplied recording paper P can be pressed between the photoreceptor drum 50 and the transfer roller 58 and the image can be transferred onto the recording paper P.

A separating brush (separating device) 59 is brought into contact with the recording paper P under pressure almost simultaneously with the transfer roller 58 to remove the charge on the recording paper P. The recording paper P is thereby separated from the peripheral surface of the photoreceptor drum 50 and transported to a fixing unit 60, where the recording paper P is heated and pressed between a heat roller 601 and a press roller 602 to fix the toner by melting it onto it. Then, the recording paper P is discharged to the outside of the electrophotographic image forming apparatus by a discharge roller 61. The transfer roller 58 and the separating brush 59 retract from the photoreceptor drum 50 after the recording paper P has passed for preparation for the next toner image formation.

After the separation of the recording paper P, a doctor blade 621 of a cleaning device 62 is pressed against the photoreceptor drum 50 to remove the residual toner thereon. Then, the pre-exposing device 51 eliminates the charge on the photoreceptor drum 50, and the charging device 52 charges the photoreceptor drum 50 for the next image forming process.

Reference numeral 70 denotes a removable process cartridge including a photoreceptor, a charging device, a transfer device, separating device and a cleaning device.

Examples in which the adhesive material of the invention is used in a processing device will be hereinafter described.

Example of Use of Adhesive Material in Cleaning Device

Figure 2:
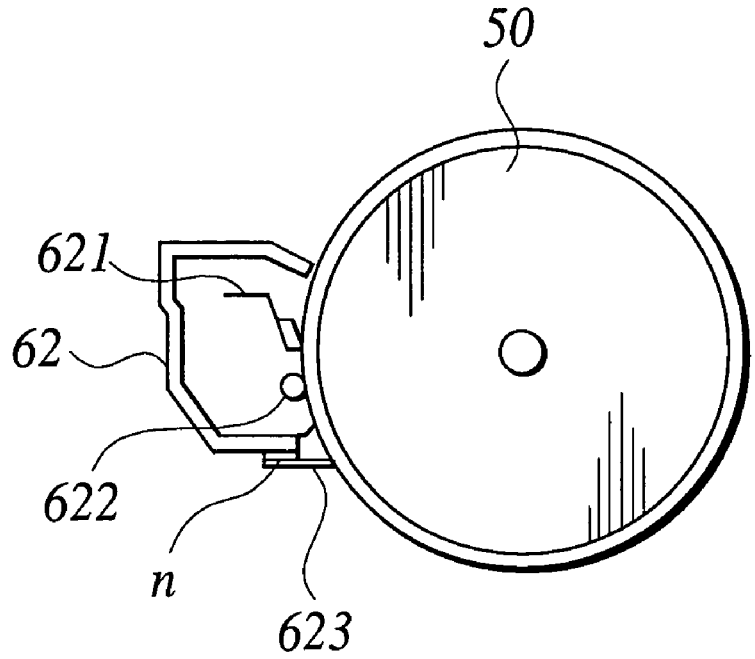
FIG. 2 shows an example of a cleaning device in which an adhesive material for a processing device according to an embodiment of the invention is used.

FIG. 2 shows an example in which the adhesive material of the embodiment is used in a cleaning device. As shown in FIG. 2, a cleaning device 62 includes a cleaning blade 621 for scraping toner off the photoreceptor drum 50 and a cleaning roller for recovering the toner scraped off by the cleaning blade 621. However, some of the toner scraped off by the cleaning blade is not recovered by the cleaning roller and tends to scatter out of the cleaning device and contaminate the other processing devices, resulting in image defects. To prevent the scattering of the toner, a seat member (such as MYLAR, registered trademark) 623 for receiving the toner which could not be recovered by the cleaning roller 622 is disposed along an exterior wall at a lower part of the cleaning device 62. The adhesive material n of the embodiment is used as a means for bonding the sheet member 623 to the exterior wall of the cleaning device. In the drawing, reference numeral 622 represents the cleaning roller.

Example of Use of Adhesive Material in Developing Device

Figure 3:
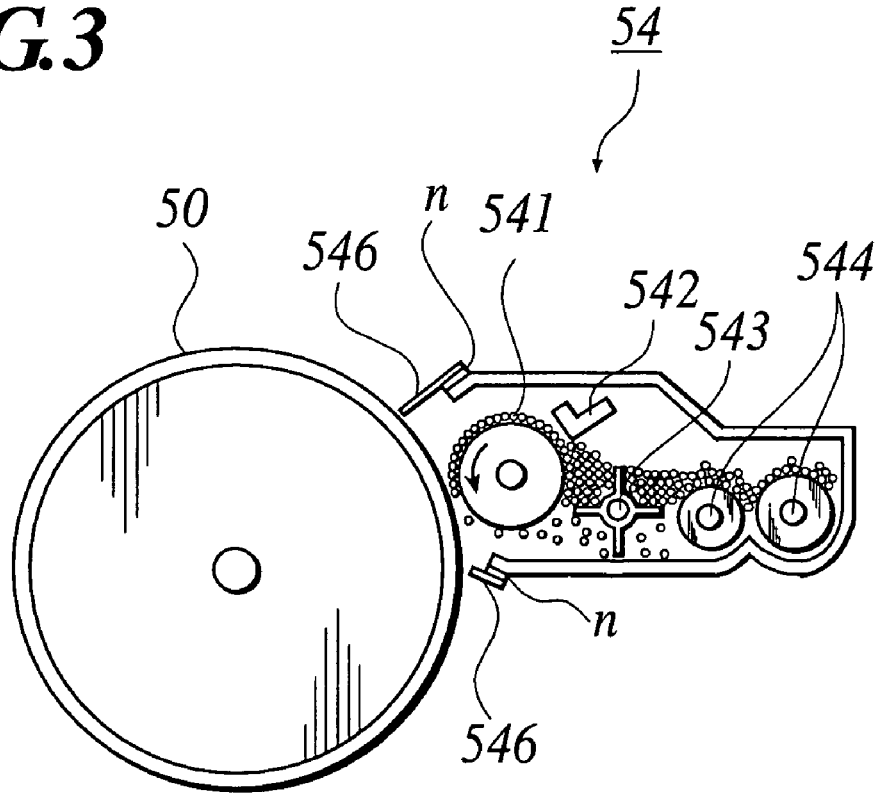
FIG. 3 shows an example of a developing device in which an adhesive material for a processing device according to an embodiment of the invention is used.

FIG. 3 shows an example in which the adhesive material of the embodiment is used in a developing device. As shown in FIG. 3, a developing device 54 is located adjacent to the photoreceptor drum 50 and contains a developer comprising a toner and a carrier. The developer is fed for development by the rotation of the developing sleeve 541. The toner is likely to be scattered by electrical and mechanical forces applied to the toner during the feeding of the developer and the developing process. Part of the scattered toner scatters out of the developing device 54 and contaminates the other processing devices, resulting in image defects. To prevent the scattering of the toner, urethane sheets 546 are provided along exterior walls at upper and lower parts of the developing device 54. The adhesive material n of the embodiment is used as a means for bonding the urethane sheets to the exterior walls of the developing device 54.

In the embodiment, the process cartridge is an integrated and detachable processing devices which include a photoreceptor, a charging device, a transfer device, a separating device and a cleaning device. However, the process cartridge is not limited to this. That is, all or a part of the processing devices may not be integrated and may be separated. The process cartridge comprises at least one type of processing devices, i.e., a charging device, a transfer device, a separating device and a cleaning device, and a photoreceptor. Further, as an adhesive material for a processing device, which is a coupling means for assembling at least one of a plurality of processing devices, an adhesive material including a volatile gas component in an amount of 0.1–9 $\mu g/cm^2$, an adhesive material including monomer residue in an amount of 0.1–7.5 $\mu g/cm^2$, or an adhesive material including solvent residue in an amount of 0.001–0.007 $\mu g/cm^2$, is used.

It is preferable that the amounts of volatile gas, monomer residue and/or solvent residue are/is in the prescribed range above at the beginning of use of the apparatus including adhesive material. However even if the adhesive material does not have volatile gas component, monomer residue and/or solvent residue in the prescribed range above at the beginning of use of the apparatus, it is also within the invention if at any time the adhesive material have at least one of those satisfying the range above.

The following examples will further illustrate the embodiment. The scope of the invention is not limited to the examples.

EXAMPLE 1

A cleaning device having an exterior wall to which a sheet member for receiving toner is attached by using an adhesive material as shown in FIG. 2 was incorporated in the electrophotographic image forming apparatus shown in FIG. 1. As the electrophotographic photoreceptor was used a commercially available organic photoreceptor comprising a cylindrical aluminum support and a laminate of an intermediate layer of a polyamide resin, a charge generating layer including a phthalocyanine pigment and a butyral resin, and a charge transporting layer including a styryltriphenylamine compound as a charge transporting material and a polycarbonate resin. Six cleaning devices were prepared and different types of adhesive materials as shown in Table 1 were used in each cleaning device. The cleaning devices are referred to as cleaning devices 1 to 6. The organic photoreceptor and electrophotographic image forming apparatuses 1–6 in which the cleaning devices 1–6 were incorporated, respectively, were left at 30° C. and 80% RH (relative humidity) for ten days and then at 10° C. and 30% RH. Then, a copy of an image with a halftone area was produced and the uniformity of the image was evaluated.

Each of the adhesive materials was prepared by heating a commercially available adhesive material (having an adhesive layer of a silicone resin (No. 501, a product of Nitto Denko Co. Ltd.)) in vacuum. The volatile gas amount, residual monomer amount and residual solvent amount of the adhesive materials were adjusted by altering the heating conditions as shown in Table 1.

| Cleaning Device No. | Type of Adhesive Material (Heating Conditions) | Volatile Gas Amount ($\mu g/cm^2$) | Residual Solvent Amount ($\mu g/cm^2$) | Residual Monomer Amount ($\mu g/cm^2$) | Image Unevenness | Note |
|---|---|---|---|---|---|---|
| 1 | 1(50° C./7 hour) | 1.7 | 0.004 | 1.7 | A | Within Invention |
| 2 | 2(40° C./9 hour) | 2.1 | 0.005 | 2.1 | A | Within Invention |
| 3 | 3(60° C./8 hour) | 7.1 | 0.007 | 7.1 | A | Within Invention |
| 4 | 4(80° C./1 hour) | 7.3 | 0.008 | 7.3 | B | Within Invention |
| 5 | 5(40° C./2 hour) | 8.9 | 0.349 | 8.5 | B | Within Invention |
| 6 | 6(20° C./4 hour) | 10 | 0.36 | 9.5 | C | Out of Invention |

Evaluation of Image Uniformity is Rated as Follows:

A: no unevenness is observed in the halftone area;

B: light streaks are observed in the halftone area; and

C: dark streaks are observed in the halftone area The results are summarized in Table 1.

As shown in Table 1, when an adhesive material having a volatile gas amount, a residual monomer amount and a residual solvent amount within the ranges of the invention was used (cleaning device 1–3), no image unevenness occurred. However, when an adhesive material having a residual solvent amount out of the range of the invention was used (cleaning device 4), and when an adhesive material having a residual monomer amount and a residual solvent amount out of the ranges of the invention was used (cleaning device 5), slight image unevenness occurred. When an adhesive material having a volatile gas amount, a residual monomer amount and a residual solvent amount out of the ranges of the invention was used (cleaning device 6), strong image unevenness occurred.

EXAMPLE 2

The adhesive materials prepared in the same manner as in Example 1 were used to bond urethane sheets shown in FIG. 3 to external walls of developing devices. The developing devices were incorporated in the electrophotographic image forming apparatus shown in FIG. 1 and evaluation of the printed images was performed in the same manner as in Example 1. The results were substantially the same as in Example 1.

As is clear from the results in the examples, when an adhesive material which satisfies the conditions of the invention is used as the coupling means to assemble a processing device such as a cleaning device or a developing device, it is possible to prevent deterioration of the characteristics of the electrophotographic photoreceptor and produce a high-quality electrophotographic image free from unevenness.

The present invention is not limited to the above-described embodiments.

The entire disclosure of Japanese Patent Publication (Laid-open) No. 2003-129027A including specification, claims, drawings and abstract, is incorporated into the present invention in its entirety.

What is claimed is:

1. An image forming apparatus comprising:

a photoreceptor; and a plurality of processing devices to form an image, wherein at least one of the processing devices include a portion assembled by an adhesive material including a volatile gas component in an amount of 0.1–9 $\mu g/cm^2$.

2. The image forming apparatus of claim 1, wherein the adhesive material comprises monomer residue in an amount of 0.1–7.5 $\mu g/cm^2$.

3. The image forming apparatus of claim 2, wherein the adhesive material comprises solvent residue in an amount of 0.001–0.007 $\mu g/cm^2$.

4. The image forming apparatus of claim 3, comprising the processing devices of a charging device to charge the photoreceptor, an exposing device to form a latent image on the photoreceptor, a developing device to develop the latent image to form a toner image, a transferring device to transfer the toner image on an image support, a cleaning device to remove residual toner on the photoreceptor, a feeding device to feed the image support and a separating device to separate the image support with transferred toner image from the photoreceptor, and wherein at least one of the processing devices comprise the adhesive material.

5. The image forming apparatus of claim 4, wherein the adhesive material comprises a support and an adhesive layer.

6. The image forming apparatus of claim 1, wherein the adhesive material comprises solvent residue in an amount of 0.001–0.007 $\mu g/cm^2$.

7. The image forming apparatus of claim 1, comprising the processing devices of a charging device to charge the photoreceptor, an exposing device to form a latent image on the photoreceptor, a developing device to develop the latent image to form a toner image, a transferring device to transfer the toner image on an image support, a cleaning device to remove residual toner on the photoreceptor, a feeding device to feed the image support and a separating device to separate the image support with transferred toner image from the photoreceptor.

8. The image forming apparatus of claim 1, comprising the processing devices of a charging device to charge the photoreceptor, an exposing device to form a latent image on the photoreceptor, a developing device to develop the latent image to form a toner image, a transferring device to transfer the toner image on an image support, a cleaning device to remove residual toner on the photoreceptor, a feeding device to feed the image support and a separating device to separate the image support with transferred toner image from the photoreceptor, and wherein at least one of the processing devices comprise the adhesive material.

9. A process cartridge comprising:

a photoreceptor; and a processing device including a portion assembled by an adhesive material with a volatile gas component in an amount of 0.1 to 9 $\mu g/cm^2$.

10. The process cartridge of claim 9, wherein the adhesive material comprises a monomer residue in an amount of 0.1–7.5 $\mu g/cm^2$.

11. The process cartridge of claim 10, wherein the adhesive material comprises a solvent residue in an amount of 0.001–0.007 $\mu g/cm^2$.

12. The process cartridge of claim 11, comprising a plurality of process devices which are selected from a charging device to charge the photoreceptor, an exposing device to form a latent image on the photoreceptor, a developing device to develop the latent image to form a toner image, a transferring device to transfer the toner image on an image support, a cleaning device to remove residual toner on the photoreceptor, a feeding device to feed the image support and a separating device to separate the image support with transferred toner image from the photoreceptor, and wherein at least one of the processing devices comprise the adhesive material.

13. The process cartridge of claim 9, wherein the adhesive material comprises a solvent residue in an amount of 0.001–0.007 $\mu g/cm^2$.

14. The process cartridge of claim 9, comprising the process devices selected from a charging device to charge the photoreceptor, an exposing device to form a latent image on the photoreceptor, a developing device to develop the latent image to form a toner image, a transferring device to transfer the toner image on an image support, a cleaning device to remove residual toner on the photoreceptor, a feeding device to feed the image support and a separating device to separate the image support with transferred toner image from the photoreceptor.

15. A method for manufacturing an image forming apparatus having a photoreceptor and processing devices to form an image comprising: coupling a first portion and a second portion to form one of the processing devices with an adhesive material including a volatile gas component in an amount of 0.1 to 9 $\mu g/cm^2$.

16. The method of claim 15, wherein the adhesive material includes a support and an adhesive layer.

* * * * *